US007516066B2

(12) United States Patent
Schuijers et al.

(10) Patent No.: US 7,516,066 B2
(45) Date of Patent: Apr. 7, 2009

(54) AUDIO CODING

(75) Inventors: Erik Gosuinus Petrus Schuijers, Eindhoven (NL); Adriaan Johannes Rijnberg, Eindhoven (NL); Natasa Topalovic, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 781 days.

(21) Appl. No.: 10/520,876

(22) PCT Filed: Jul. 11, 2003

(86) PCT No.: PCT/IB03/03152

§ 371 (c)(1),
(2), (4) Date: Jan. 11, 2005

(87) PCT Pub. No.: WO2004/008437

PCT Pub. Date: Jan. 22, 2004

(65) Prior Publication Data

US 2005/0261896 A1 Nov. 24, 2005

(30) Foreign Application Priority Data

Jul. 16, 2002 (EP) ..... 02077870

(51) Int. Cl.
*G10L 19/00* (2006.01)
*G10L 19/14* (2006.01)
*G10L 21/00* (2006.01)
*G10L 21/04* (2006.01)

(52) U.S. Cl. ..... 704/219; 704/211; 704/500; 704/503

(58) Field of Classification Search ..... None
See application file for complete search history.

(56) References Cited

U.S. PATENT DOCUMENTS 5,749,064 A 5/1998 Pawate et al.

(Continued)

FOREIGN PATENT DOCUMENTS

EP 0899720 A2 3/1999

(Continued)

OTHER PUBLICATIONS

Kumaresan et al., "Model-based approach to envelope and positive instantaneous frequency estimation of signals with speech applications", The Journal of the Acoustical Society of America, vol. 105, Issue 3, Mar. 1999, pp. 1912-1924.*

(Continued)

*Primary Examiner*—David R Hudspeth
*Assistant Examiner*—Brian L Albertalli

(57) ABSTRACT

According to a first aspect of the invention, at least part of an audio signal is coded in order to obtain an encoded signal, the coding comprising predictive coding the at least part of the audio signal in order to obtain prediction coefficients which represent temporal properties, such as a temporal envelope, of the at least part of the audio signal, transforming the prediction coefficients into a set of times representing the prediction coefficients, and including the set of times in the encoded signal. Especially the use of a time domain derivative or equivalent of the Line Spectral Representation is advantageous in coding such prediction coefficients, because with this technique times or time instants are well defined which makes them more suitable for further encoding. For overlapping frame analysis/synthesis for the temporal envelope, redundancy in the Line Spectral Representation at the overlap can be exploited. Embodiments of the invention exploit this redundancy in an advantageous manner.

29 Claims, 3 Drawing Sheets

U.S. PATENT DOCUMENTS 5,781,888 A * 7/1998 Herre ..... 704/200.1

FOREIGN PATENT DOCUMENTS

WO 0169593 A1 9/2001

OTHER PUBLICATIONS

Herre, "Enhancing the Performance of Perceptual Audio Coders by Using Temporal Noise Shaping (TNS)", 101st Audio Engineering Society Convention, Los Angeles 1996, Preprint 4384.*

Athineos et al., "Frequency-domain linear prediction for temporal features", IEEE Workshop on Automatic Speech Recognition and Understanding, Nov. 30-Dec. 3, 2003, pp. 261-266.*

Kumaresan R. et al., "On representing signals using only timing information" Journal of the Acoustical Society of America, Nov. 2001, Acoust. Soc. America Through AIP, USA, vol. 110, No. 5, pp. 2421-2439, XP001176748, ISSN: 0001-4966 Abstract, paragraph '000I!, Paragraph '00VC!, Paragraph OVII!, Figure 13.

Kumaresan R. et al: "On the duality between line-spectral frequencies and zero-crossings of signals" IEEE Transactions on Speech and Audio Processing, May 2001, IEEE, USA, vol. 9, No. 4, pp. 458-461, XP002264935, ISSN: 1063-6676, abstract, paragraph '000I!, p. 459, right-hand col., line 64-line 65, p. 459, left-hand col., line 9-line 11 paragraphs 'OV.B!, '00VI!.

Kumaresan et al: On Representing signals Using Only Timing Information, vol. 110, No. 5, Nov. 2001, pp. 2421-2439, XP001176748.

Kumaresan, et al: On the Duality Between Line-Spectral Frequencies and Zero-Crossings of Signals, IEEE vol. 9, No. 4, May 2001, pp. 458-461, XP002264935.

Peter Kabal, et al: The Computation of Line Spectral Frequencies Using Chebyshev Polynomials, IEEE vol. ASSP-34, No. 6, Dec. 1986.

Joseph Rothweiler: A Rootfinding Algorithm for Line Spectral Frequencies, IEEE 1999, pp. 661-664.

Engin Erzin, et al: Interframe Differential Vector Coding of Line Spectrum Frequencies, IEEE 1993, , pp. 25-28.

J. W. Wong, et al: Fast Time Scale Modification Using Envelope-Matching Technique EM-TSM, IEEE May 1998, pp. 550-553.

K.K. Paliwal, et al: Efficient Vector Quantization of LPC Parameters AT 24 Bits/Frame, SP.24, IEEE 1991, pp. 661-664.

Robert J. Hanson, J. Acoustical Society of America, vol. 57, No. 1, Apr. 1975, pp. S1-S77.

Frank K. Soong, et al: Line Spectrum Pair_(LSP)_And_Speech_Data_Compression, IEEE 1984, pp. 1-4.

R. Viswanathan, et al: Quantization Properties of Transmission Parameters in Linear Predictive Systems, vol. ASSP-23, No. 3, Jun. 1975, pp. 309-321.

Agustine H. Gray Jr: Quantization and Bit Allocation in Speech Processing, IEEE vol. ASSP-24, No. 6, Dec. 1976, pp. 459-473.

Frank K. Song, et al: Optimal Quantization of LSP Parameters, IEEE vol. 1, No. 1, Jan. 1991, pp. 15-24.

Noboru Sugamura, et al: Speech Data Compression by LSP Speech Analysis-Synthesis Technique, Aug. 1981, vol. J64, No. 8, pp. 599-606.

* cited by examiner

AUDIO CODING

The invention relates to coding at least part of an audio signal.

In the art of audio coding, Linear Predictive Coding (LPC) is well known for representing spectral content. Further, many efficient quantization schemes have been proposed for such linear predictive systems, e.g. Log Area Ratios [1], Reflection Coefficients [2] and Line Spectral Representations such as Line Spectral Pairs or Line Spectral Frequencies [3, 4, 5].

Without going into much detail on how the filter-coefficients are transformed to a Line Spectral Representation (reference is made to [6, 7, 8, 9, 10] for more detail), the results are that an M-th order all-pole LPC filter H(z) is transformed to M frequencies, often referred to as Line Spectral Frequencies (LSF). These frequencies uniquely represent the filter H(z). As an example see FIG. 1. Note that for clarity the Line Spectral Frequencies have been depicted in FIG. 1 as lines towards the amplitude response of the filter, although they are nothing more than just frequencies, and thus do not in themselves contain any amplitude information whatsoever.

An object of the invention is to provide advantageous coding of at least part of an audio signal. To this end, the invention provides a method of encoding, an encoder, an encoded audio signal, a storage medium, a method of decoding, a decoder, a transmitter, a receiver and a system as defined in the independent claims. Advantageous embodiments are defined in the dependent claims.

According to a first aspect of the invention, at least part of an audio signal is coded in order to obtain an encoded signal, the coding comprising predictive coding the at least part of the audio signal in order to obtain prediction coefficients which represent temporal properties, such as a temporal envelope, of the at least part of the audio signal, transforming the prediction coefficients into a set of times representing the prediction coefficients, and including the set of times in the encoded signal. Note that times without any amplitude information suffice to represent the prediction coefficients.

Although a temporal shape of a signal or a component thereof can also be directly encoded in the form of a set of amplitude or gain values, it has been the inventor's insight that higher quality can be obtained by using predictive coding to obtain prediction coefficients which represent temporal properties such as a temporal envelope and transforming these prediction coefficients to into a set of times. Higher quality can be obtained because locally (where needed) higher time resolution can be obtained compared to fixed time-axis technique. The predictive coding may be implemented by using the amplitude response of an LPC filter to represent the temporal envelope.

It has been a further insight of the inventors that especially the use of a time domain derivative or equivalent of the Line Spectral Representation is advantageous in coding such prediction coefficients representing temporal envelopes, because with this technique times or time instants are well defined which makes them more suitable for further encoding. Therefore, with this aspect of the invention, an efficient coding of temporal properties of at least part of an audio signal is obtained, attributing to a better compression of the at least part of an audio signal.

Embodiments of the invention can be interpreted as using an LPC spectrum to describe a temporal envelope instead of a spectral envelope and that what is time in the case of a spectral envelope, now is frequency and vice versa, as shown in the bottom part of FIG. 2. This means that using a Line Spectral Representation now results in a set of times or time instances instead of frequencies. Note that in this approach times are not fixed at predetermined intervals on the time-axis, but that the times themselves represent the prediction coefficients.

The inventors realized that when using overlapping frame analysis/synthesis for the temporal envelope, redundancy in the Line Spectral Representation at the overlap can be exploited. Embodiments of the invention exploit this redundancy in an advantageous manner.

The invention and embodiments thereof are in particular advantageous for the coding of a temporal envelope of a noise component in the audio signal in a parametric audio coding schemes such as disclosed in WO 01/69593-A1. In such a parametric audio coding scheme, an audio signal may be dissected into transient signal components, sinusoidal signal components and noise components. The parameters representing the sinusoidal components may be amplitude, frequency and phase. For the transient components the extension of such parameters with an envelope description is an efficient representation.

Note that the invention and embodiments thereof can be applied to the entire relevant frequency band of the audio signal or a component thereof, but also to a smaller frequency band.

These and other aspects of the invention will be apparent from the elucidated with reference to the accompanying drawings.

The drawings only show those elements that are necessary to understand the embodiments of the invention.

Although the below description is directed to the use of an LPC filter and the calculation of time domain derivatives or equivalents of LSFs, the invention is also applicable to other filters and representations which fall within the scope of the claims.

Figure 1:
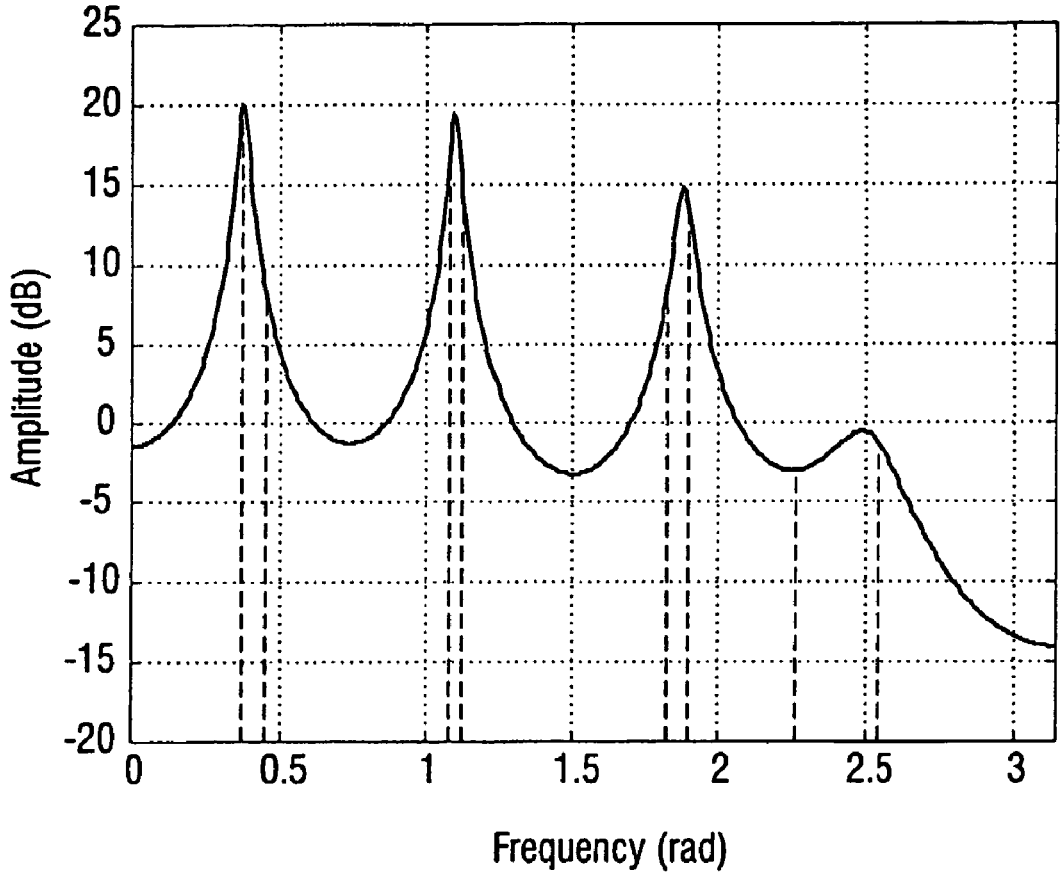
FIG. 1 shows an example of an LPC spectrum with 8 poles with corresponding 8 Line Spectral Frequencies according to prior art.
Figure 2:
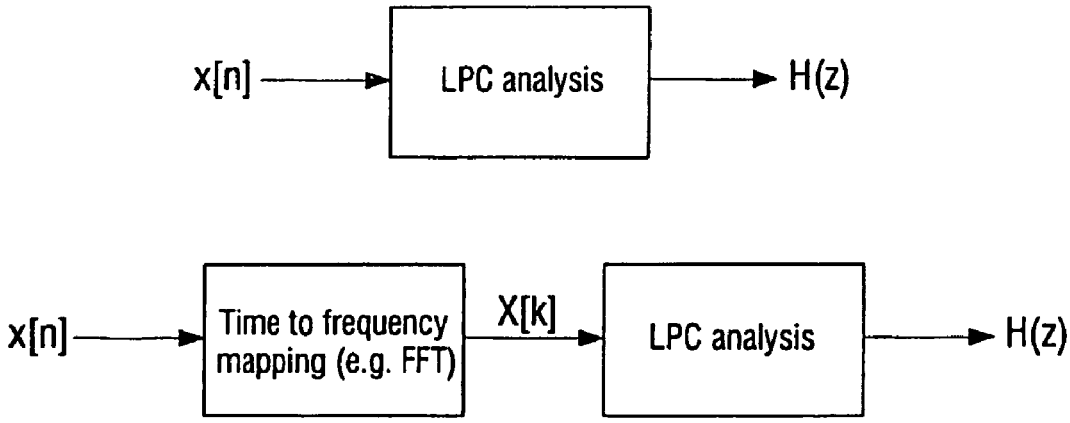
FIG. 2 shows (top) using LPC such that H(z) represents a frequency spectrum, (bottom) using LPC such that H(z) represents a temporal envelope.

FIG. 2 shows how a predictive filter such as an LPC filter can be used to describe a temporal envelope of an audio signal or a component thereof. In order to be able to use a conventional LPC filter, the input signal is first transformed from time domain to frequency domain by e.g. a Fourier Transform. So in fact, the temporal shape is transformed in a spectral shape which is coded by a subsequent conventional LPC filter which is normally used to code a spectral shape. The LPC filter analysis provides prediction coefficients which represent the temporal shape of the input signal. There is a trade-off between time-resolution and frequency resolution. Say that e.g. the LPC spectrum would consist of a number of very sharp peaks (sinusoids). Then the auditory system is less sensitive to time-resolution changes, thus less resolution is needed, also the other way around, e.g. within a transient the resolution of the frequency spectrum does not need to be accurate. In this sense one could see this as a combined coding, the resolution of the time-domain is dependent on the resolution of the frequency domain and vice versa. One could also employ multiple LPC curves for the time-domain estimation, e.g. a low and a high frequency band, also here the resolution could be dependent on the resolution of the frequency estimation etc, this could thus be exploited.

An LPC filter H(z) can generally be described as:

$$H(z) = \frac{1}{A(z)} = \frac{1}{1 + a_1 z^{-1} + a_2 z^{-2} + \ldots + a_m z^{-m}}$$

The coefficients $\alpha_i$, with i running from 1 to m, are the prediction filter coefficients resulting from the LPC analysis. The coefficients $\alpha_i$ determine H(z).

To calculate the time domain equivalents of the LSFs, the following procedure can be used. Most of this procedure is valid for a general all-pole filter H(z), so also for frequency domain. Other procedures known for deriving LSFs in the frequency domain can also be used to calculate the time domain equivalents of the LSFs.

The polynomial A(z) is split into two polynomials P(z) and Q(z) of order m+1. The polynomial P(z) is formed by adding a reflection coefficient (in lattice filter form) of +1 to A(z), Q(z) is formed by adding a reflection coefficient of −1. There's a recurrent relation between the LPC filter in the direct form (equation above) and the lattice form:

$$A_i(z)=A_{i-1}(z)+k_i z^{-i} A_{i-1}(z^{-1})$$

with i=1, 2, . . . , m, $A_0(z)=1$ and $k_i$ the reflection coefficient.

The polynomials P(z) and Q(z) are obtained by:

$$P(z)=A_m(z)+z^{-(m+1)}A_m(z^{-1})$$

$$Q(z)=A_m(z)-z^{-(m+1)}A_m(z^{-1})$$

The polynomials $P(z)=1+p_1z^{-1}+p_2z^{-2}+\ . \ . \ . \ +p_mz^{-m}+z^{-(m+1)}$ and $Q(z)=1+q_1z^{-1}+q_2z^{-2}+\ . \ . \ . \ +q_mz^{-m}-z^{-(m+1)}$ obtained in this way are even symmetrical and anti-symmetrical:

$p_1=p_m\ q_1=-q_m$ $p_2=p_{m-1}\ q_2=-q_{m-1}$

. .

. .

Some important properties of these polynomials:

All zeros of P(z) and Q(z) are on the unit circle in the z-plane.

The zeros of P(z) and Q(z) are interlaced on the unit circle and do not overlap.

Minimum phase property of A(z) is preserved after quantization guaranteeing stability of H(z).

Both polynomials P(z) and Q(z) have m+1 zeros. It can be easily seen that z=−1 and z=1 are always a zero in P(z) or Q(z). Therefore they can be removed by dividing by $1+z^{-1}$ and $1-z^{-1}$.

If m is even this leads to:

$$P'(z) = \frac{P(z)}{1 + z^{-1}}$$

$$Q'(z) = \frac{Q(z)}{1 - z^{-1}}$$

If m is odd:

$$P'(z) = P(z)$$

$$Q'(z) = \frac{Q(z)}{(1 - z^{-1})(1 + z^{-1})}$$

The zeros of the polynomials P'(z) and Q'(z) are now described by $z_i=e^{it}$ because the LPC filter is applied in the temporal domain. The zeros of the polynomials P'(z) and Q'(z) are thus fully characterized by their time t, which runs from 0 to π over a frame, wherein 0 corresponds to a start of the frame and π to an end of that frame, which frame can actually have any practical length, e.g. 10 or 20 ms. The times t resulting from this derivation can be interpreted as time domain equivalents of the line spectral frequencies, which times are further called LSF times herein. To calculate the actual LSF times, the roots of P'(z) and Q'(z) have to be calculated. The different techniques that have been proposed in [9], [10], [11] can also be used in the present context.

Figure 3:
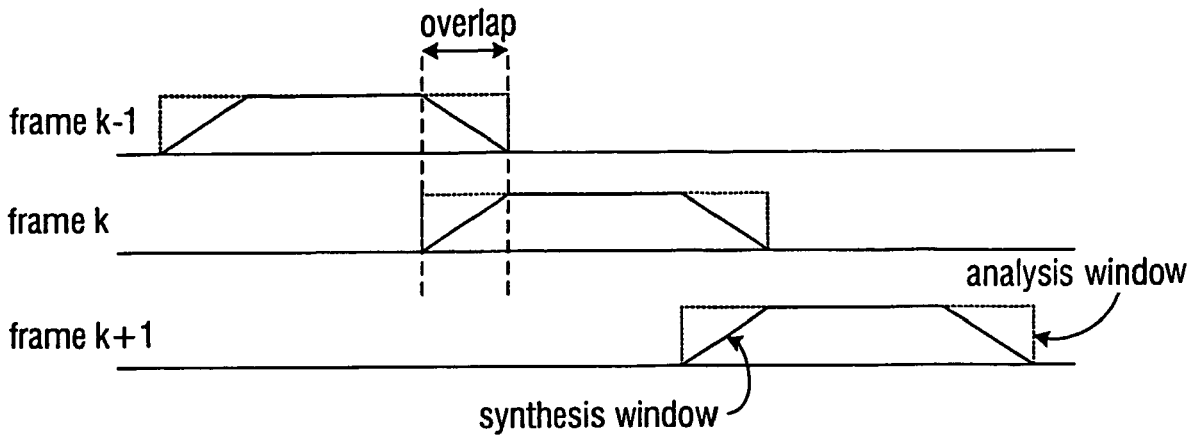
FIG. 3 shows a stylized view of exemplary analysis/synthesis windowing.

FIG. 3 shows a stylized view of an exemplary situation for analysis and synthesis of temporal envelopes. At each frame k a, not necessarily rectangular, window is used to analyze the segment by LPC. So for each frame, after conversion, a set of N LSF times is obtained. Note that N in principal does not need to be constant, although in many cases this leads to a more efficient representation. In this embodiment we assume that the LSF times are uniformly quantized, although other techniques like vector quantization could also be applied here.

Figure 4:
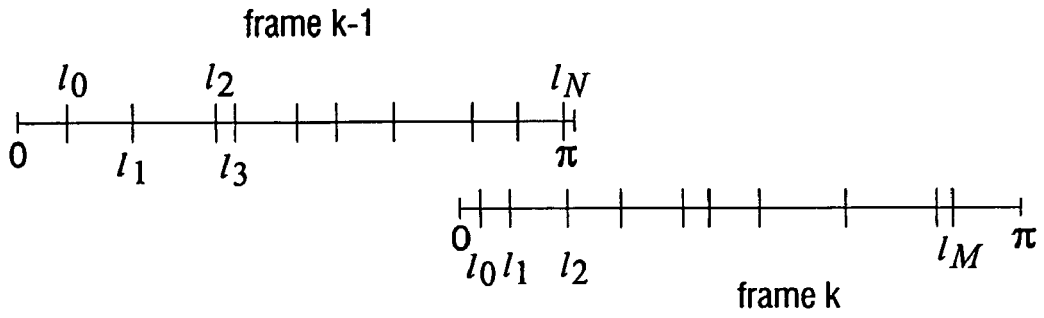
FIG. 4 shows an example sequence of LSF times for two subsequent frames.
Figure 5:
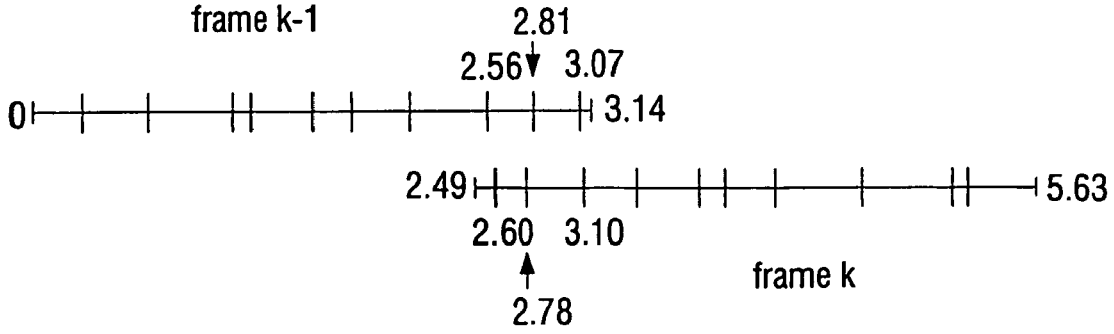
FIG. 5 shows matching of LSF times by shifting LSF times in a frame k relative to a previous frame k−1.

Experiments have shown that in an overlap area as shown in FIG. 3 there is often redundancy between the LSF times of frame k−1 with those of frame k. Reference is also made to FIGS. 4 and 5. In embodiments of the invention which are described below, this redundancy is exploited to more efficiently encode the LSF times, which helps to better compress the at least part of an audio signal. Note that FIGS. 4 and 5 show usual cases wherein the LSF times of frame k in the overlapping area are not identical but however rather close to the LSF times in frame k−1.

First Embodiment Using Overlapping Frames

In a first embodiment using overlapping frames it is assumed that the differences between LSF times of overlapping areas can be, perceptually, neglected or result in an acceptable loss in quality. For a pair of LSF times, one in the frame k−1 and one in the frame k, a derived LSF time is derived which is a weighted average of the LSF times in the pair. A weighted average in this application is to be construed as including the case where only one out of the pair of LSF times is selected. Such a selection can be interpreted as a weighted average wherein the weight of the selected LSF time is one and the weight of the non-selected time is zero. It is also possible that both LSF times of the pair have the same weight.

For example, assume LSF times $\{l_0, l_1, l_2, \ldots, l_N\}$ for frame k−1 and $\{l_0, l_1, l_2, \ldots, l_M\}$ for frame k as shown in FIG. 4. The LSF times in frame k are shifted such that a certain quantization level l is in the same position in each of the two frames. Now assume that there are three LSF times in the overlapping area for each frame, as is the case for FIG. 4 and FIG. 5. Then the following corresponding pairs can be formed: $\{l_{N-2,k-1}\ l_{0,k}, l_{N-1,k-1}\ l_{1,k}, l_{Nk-1}\ l_{2,k}\}$. In this embodiment, a new set of three derived LSF times is constructed based on the two original sets of three LSF times. A practical approach is to just take the LSF times of frame k−1 (or k), and calculate the LSF times of frame k (or k−1) by simply shifting the LSF times of frame k−1 (or k) to align the frames in time. This shifting is performed in both the encoder and the decoder. In the encoder the LSFs of the right frame k are shifted to match the ones in the left frame k−1. This is necessary to look for pairs and eventually determine the weighted average.

In preferred embodiments, the derived time or weighted average is encoded into the bit-stream as a 'representation level' which is an integer value e.g. from 0 until 255 (8 bits) representing 0 until pi. In practical embodiments also Huffman coding is applied. For a first frame the first LSF time is coded absolutely (no reference point), all subsequent LSF times (including the weighted ones at the end) are coded differentially to their predecessor. Now, say frame k could make use of the 'trick' using the last 3 LSF times of frame k−1. For decoding, frame k then takes the last three representation levels of frame k−1 (which are at the end of the region 0 until 255) and shift them back to its own time-axis (at the beginning of the region 0 until 255). All subsequent LSF times in frame k would be encoded differentially to their predecessor starting with the representation level (on the axis of frame k) corresponding to the last LSF in the overlap area. In case frame k could not make use of the 'trick' the first LSF time of frame k would be coded absolutely and all subsequent LSF times of frame k differential to their predecessor.

A practical approach is to take averages of each pair of corresponding LSF times, e.g. $(l_{N-2,k-1}+l_{0,k})/2$, $(l_{N-1,k-1}+l_{1,k})/2$ and $(l_{N,k-1}+l_{2,k})/2$.

Figure 6:
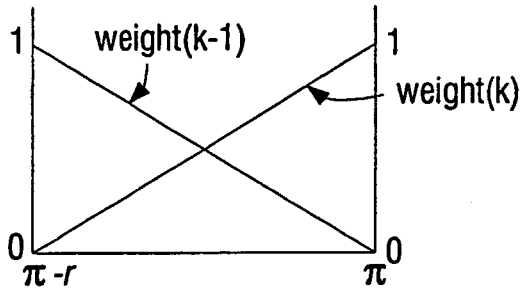
FIG. 6 shows weighting functions as function of overlap.

An even more advantageous approach takes into account that the windows typically show a fade-in/fade-out behavior as shown in FIG. 3. In this approach a weighted mean of each pair is calculated which gives perceptually better results. The procedure for this is as follows. The overlapping area corresponds to the area (π-r, π). Weight functions are derived as depicted in FIG. 6. The weight to the times of the left frame k−1 for each pair separately is calculated as:

$$w_{k-1} = \frac{\pi - l_{mean}}{r}$$

where $l_{mean}$ is the mean (average) of a pair, e.g.: $l_{mean}=(l_{N-2,k-1}+l_{0,k})/2$.

The weight for frame k is calculated as $w_k=1-w_{k-1}$.

The new LSF times are now calculated as:

$$l_{weighted}=l_{k-1}w_{k-1}+l_k w_k$$

where $l_{k-1}$ and $l_k$ form a pair. Finally the weighted LSF times are uniformly quantized.

As the first frame in a bit-stream has no history, the first frame of LSF times always need to be coded without exploitation of techniques as mentioned above. This may be done by coding the first LSF time absolutely using Huffman coding, and all subsequent values differentially to their predecessor within a frame using a fixed Huffman table. All frames subsequent to the first frame can in essence make advantage of an above technique. Of course such a technique is not always advantageous. Think for instance of a situation where there are an equal number of LSF times in the overlap area for both frames, but with a very bad match. Calculating a (weighted) mean might then result in perceptual deterioration. Also the situation where in frame k−1 the number of LSF times is not equal to the number of LSF times in frame k is preferably not defined by an above technique. Therefore for each frame of LSF times an indication, such as a single bit, is included in the encoded signal to indicate whether or not an above technique is used, i.e. should the first number of LSF times be retrieved from the previous frame or are they in the bit-stream? For example, if the indicator bit is 1: the weighted LSF times are coded differentially to their predecessor in frame k−1, for frame k the first number of LSF times in the overlap area are derived from the LSFs in frame k−1. If the indicator bit is 0, the first LSF time of frame k is coded absolutely, all following LSFs are coded differentially to their predecessor.

In a practical embodiment, the LSF time frames are rather long, e.g. 1440 samples at 44.1 kHz; in this case only around 30 bits per second are needed for this extra indication bit. Experiments showed that most of the frames could make use of the above technique advantageously, resulting in net bit savings per frame.

Further Embodiment Using Overlapping Frames

According to a further embodiment of the invention, the LSF time data is loss-lessly encoded. So instead of merging the overlap-pairs to single LSF times, the differences of the LSF times in a given frame are encoded with respect to the LSF times in another frame. So in the example of FIG. 3 when the values $l_0$ until $l_N$ are retrieved of frame k−1, the first three values $l_0$ until $l_3$ from frame k are retrieved by decoding the differences (in the bit-stream) to $l_{N-2}$, $l_{N-1}$, $l_N$ of frame k−1 respectively. By encoding an LSF time with reference to an LSF time in an other frame which is closer in time than any other LSF time in the other frame, a good exploitation of redundancy is obtained because times can best be encoded with reference to closest times. As their differences are usually rather small, they can be encoded quite efficiently by using a separate Huffman table. So apart from the bit denoting whether or not to use a technique as described in the first embodiment, for this particular example also the differences $l_{0,k}-l_{N-2,k-1}$, $l_{1,k}-l_{N-1,k-1}$, $l_{2,k}-l_{N,k-1}$ are placed in the bit-stream, in the case the first embodiment is not used for the overlap concerned.

Although less advantageously, it is alternatively possible to encode differences relative to other LSF times in the previous frame. For example, it is possible to only code the difference of the first LSF time of the subsequent frame relative to the last LSF time of the previous frame and then encode each subsequent LSF time in the subsequent frame relative to the preceding LSF time in the same frame, e.g. as follows: for frame k−1: $l_{N-1}-l_{N-2}$, $l_N-l_{N-1}$ and subsequently for frame k: $l_{0,k}-l_{N,k-1}$, $l_{1,k}-l_{0,k}$ etc.

System Description

Figure 7:
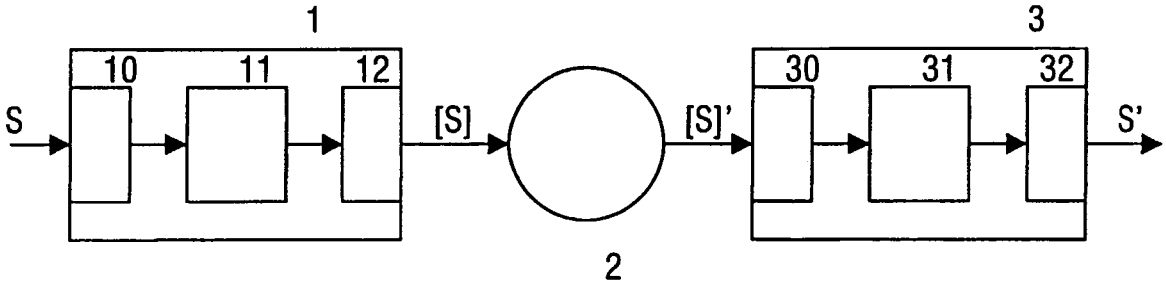
FIG. 7 shows a system according to an embodiment of the invention.

FIG. 7 shows a system according to an embodiment of the invention. The system comprises an apparatus 1 for transmitting or recording an encoded signal [S]. The apparatus 1 comprises an input unit 10 for receiving at least part of an audio signal S, preferably a noise component of the audio signal. The input unit 10 may be an antenna, microphone, network connection, etc. The apparatus 1 further comprises an encoder 11 for encoding the signal S according to an above described embodiment of the invention (see in particular FIGS. 4, 5 and 6) in order to obtain an encoded signal. It is possible that the input unit 10 receives a full audio signal and provides components thereof to other dedicated encoders. The encoded signal is furnished to an output unit 12 which transforms the encoded audio signal in a bit-stream [S] having a suitable format for transmission or storage via a transmission medium or storage medium 2. The system further comprises a receiver or reproduction apparatus 3 which receives the encoded signal [S] in an input unit 30. The input unit 30 furnishes the encoded signal [S] to the decoder 31. The decoder 31 decodes the encoded signal by performing a decoding process which is substantially an inverse operation of the encoding in the encoder 11 wherein a decoded signal S' is obtained which corresponds to the original signal S except for those parts which were lost during the encoding process. The decoder 31 furnishes the decoded signal S' to an output unit 32 that provides the decoded signal S'. The output unit 32 may be reproduction unit such as a speaker for reproducing the decoded signal S'. The output unit 32 may also be a transmitter for further transmitting the decoded signal S' for example over an in-home network, etc. In the case the signal S' is reconstruction of a component of the audio signal such as a noise component, then the output unit 32 may include combining means for combining the signal S' with other reconstructed components in order to provide a full audio signal.

Embodiments of the invention may be applied in, inter alia, Internet distribution, Solid State Audio, 3G terminals, GPRS and commercial successors thereof.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. This word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

REFERENCES

[1] R. Viswanathan and J. Makhoul, "Quantization properties of transmission parameters in linear predictive sytems", IEEE Trans. Acoust., Speech, Signal Processing, vol. ASSP-23, pp. 309-321, June 1975.

[2] A. H. Gray, Jr. and J. D. Markel, "Quantization and bit allocation in speech processing", IEEE Trans. Acoust., Speech, Signal Processing, vol. ASSP-24, pp. 459-473, December 1976.

[3] F. K. Soong and B.-H. Juang, "Line Spectrum Pair (LSP) and Speech Data Compression", Proc. ICASSP-84, Vol. 1, pp. 1.10.1-4, 1984.

[4] K. K. Paliwal, "Efficient Vector Quantization of LPC Parameters at 24 Bits/Frame", IEEE Trans. on Speech and Audio Processing, Vol. 1, pp. 3-14, January 1993.

[5] F. K. Soong and B.-H. Juang, "Optimal Quantization of LSP Parameters", IEEE Trans. on Speech and Audio Processing, Vol. 1, pp. 15-24, January 1993.

[6] F. Itakura, "Line Spectrum Representation of Linear Predictive Coefficients of Speech Signals", J. Acoust. Soc. Am., 57, 535 (A), 1975.

[7] N. Sagumura and F. Itakura, "Speech Data Compression by LSP Speech Analysis-Synthesis Technique", Trans. IECE '81/8, Vol. J 64-A, No. 8, pp. 599.606.

[8] P. Kabal and R. P. Ramachandran, "Computation of line spectral frequencies using chebyshev polynomials", IEEE Trans. on ASSP, vol. 34, no. 6, pp. 1419-1426, December 1986.

[9] J. Rothweiler, "A root finding algorithm for line spectral frequencies", ICASSP-99.

[10] Engin Erzin and A. Enis Cetin, "Interframe Differential Vector Coding of Line Spectrum Frequencies", Proc. of the Int. Conf. on Acoustic, Speech and Signal Processing 1993 (ICASSP '93), Vol. II, pp. 25-28, 27 Apr. 1993

The invention claimed is:

1. A method of coding at least part of an audio signal with an audio encoder in order to obtain an encoded signal, the method comprising:

predictive coding the at least part of the audio signal in the audio coder in order to obtain prediction coefficients which represent temporal properties of the at least part of the audio signal;

transforming the prediction coefficients into a set of times representing the prediction coefficients; and including the set of times in the encoded signal, wherein:

the at least part of an audio signal is segmented in at least a first frame and a second frame the first frame and the second frame have an overlap including at least one time of each frame, and for a pair of times consisting of one time of the first frame in the overlap and one time of the second frame in the overlap, a derived time is included in the encoded signal, which derived time is a weighted average of the one time of the first frame and the one time of the second frame.

2. The method of claim 1, wherein the predictive coding is performed by a using a filter and wherein the prediction coefficients are filter coefficients.

3. The method of claim 1, wherein the predictive coding is a linear predictive coding.

4. The method of claim 1, wherein prior to the predictive coding step a time domain to frequency domain transform is performed on the at least part of an audio signal in order to obtain a frequency domain signal, and wherein the predictive coding step is performed on the frequency domain signal rather than on the at least part of an audio signal.

5. The method of claim 1, wherein the times are time domain derivatives or equivalents of line spectral frequencies.

6. The method of claim 1, wherein the derived time is equal to a selected one of the times of the pair of times.

7. The method of claim 1, wherein a time closer to a boundary of a frame has lower weight for determining the weighted average than a time further away from the boundary.

8. The method of claim 1, wherein an indicator is included in the encoded signal, which indicator indicates whether the encoded signal includes a derived time in the overlap to which the indicator relates.

9. The method of claim 1, wherein an indicator is included in the encoded signal, which indicator indicates a type of coding that is used to encode the times or derived times in the overlap to which the indicator relates.

10. A method of coding at least part of an audio signal with an audio encoder in order to obtain an encoded signal, the method comprising:

predictive coding the at least part of the audio signal in the audio coder in order to obtain prediction coefficients that represent temporal properties of the at least part of the audio signal;

transforming the prediction coefficients into a set of times representing the prediction coefficients; and including the set of times in the encoded signal, wherein the at least part of an audio signal includes at least a first frame and a second frame, the first frame and the second frame having an overlap including at least one time of each frame, and a given time of the second frame is differentially encoded with respect to a time in the first frame.

11. The method of claim 10, wherein the given time of the second frame is differentially encoded with respect to a time in the first frame which is closer in time to the given time in the second frame than any other time in the first frame.

12. The method of claim 10, wherein an indicator is included in the encoded signal, which indicator indicates whether the second frame is differentially encoded in the overlap to which the indicator relates.

13. An encoder for coding at least part of an audio signal in order to obtain an encoded signal, the encoder comprising:

a predictive coding unit that is configured to code the at least part of the audio signal in order to obtain prediction coefficients that represent temporal properties of the at least part of the audio signal, and a transforming unit that is configured to transform the prediction coefficients into a set of times representing the prediction coefficients; and wherein:

the encoder is configured to include the set of times in the encoded signal, the times are related to at least a first frame and a second frame in the at least part of an audio signal and wherein the first frame and the second frame have an overlap that includes at least one time of each frame, and the encoded signal includes at least one derived time that is a weighted average of the one time of the first frame and the one time of the second frame.

14. The encoder of claim 13, wherein the encoded signal includes an indicator that indicates whether or not the encoded signal includes a derived time in the overlap to which the indicator relates.

15. A transmitter comprising:

an input unit for receiving at least part of an audio signal, an encoder as claimed in claim 13 for encoding the at least part of an audio signal to obtain an encoded signal, and an output unit for transmitting the encoded signal.

16. The encoder of claim 13, wherein the derived time is equal to a selected one of the times of the pair of times.

17. The encoder of claim 13, wherein a time closer to a boundary of a frame has lower weight for determining the weighted average than a time further away from the boundary.

18. The encoder of claim 13, wherein an indicator is included in the encoded signal, which indicator indicates whether the encoded signal includes a derived time in the overlap to which the indicator relates.

19. The encoder of claim 18, wherein the given time of the second frame is differentially encoded with respect to a time in the first frame which is closer in time to the given time in the second frame than any other time in the first frame.

20. The encoder of claim 18, wherein for a pair of times consisting of one time of the first frame in the overlap and one time of the second frame in the overlap, a derived time is included in the encoded signal, which derived time is a weighted average of the one time of the first frame and the one time of the second frame.

21. The encoder of claim 18, wherein the derived time is equal to a selected one of the times of the pair of times.

22. The encoder of claim 18, wherein a time closer to a boundary of a frame has lower weight for determining the weighted average than a time further away from the boundary.

23. A method of decoding an encoded signal representing at least part of an audio signal with an audio decoder, the encoded signal including a set of times representing prediction coefficients that represent temporal properties of the at least part of the audio signal, the method comprising:

deriving the temporal properties from the set of times, using the temporal properties in the audio decoder to obtain a decoded signal from the encoded signal, and providing the decoded signal, wherein:

the times are related to at least a first frame and a second frame in the at least part of an audio signal, the first frame and the second frame have an overlap that includes at least one time of each frame, the encoded signal includes at least one derived time that is a weighted average of a pair of times consisting of one time of the first frame in the overlap and one time of the second frame in the overlap, and wherein the method includes using the at least one derived time in decoding the first frame and in decoding the second frame.

24. A method of decoding as claimed in claim 23, wherein deriving the temporal properties from the set of times includes transforming the set of times to obtain the prediction coefficients, and deriving the temporal properties from the prediction coefficients.

25. The method of claim 23, wherein the encoded signal includes an indicator that indicates whether the encoded signal includes a derived time in the overlap to which the indicator relates, and the method includes obtaining the indicator from the encoded signal, and only in the case that the indicator indicates that the overlap to which the indicator relates does include a derived time, using the at least one derived time in decoding the first frame as well as in decoding the second frame.

26. A decoder for decoding an encoded signal that includes a set of times representing prediction coefficients that represent temporal properties of at least part of an audio signal, wherein the decoder is configured to:

derive the temporal properties from the set of time, use these temporal properties in order to obtain a decoded signal, and provide the decoded signal;

wherein:

the times are related to at least a first frame and a second frame in the at least part of an audio signal the first frame and the second frame have an overlap that includes at least one time of each frame, the encoded signal includes at least one derived time that is a weighted average of a pair of times consisting of one time of the first frame in the overlap and one time of the second frame in the overlap, and the decoder uses the at least one derived time in decoding the first frame and in decoding the second frame.

27. A receiver comprising:

an input unit for receiving an encoded signal representing at least part of an audio signal, a decoder as claimed in claim 26 for decoding the encoded signal to obtain a decoded signal, and an output unit for providing the decoded signal.

28. The decoder of claim 26, wherein the encoded signal includes an indicator that indicates whether the encoded signal includes a derived time in the overlap to which the indicator relates, and the decoder obtains the indicator from the encoded signal, and uses the at least one derived time in decoding the first frame and in decoding the second frame only in the case that the indicator indicates that the overlap to which the indicator relates includes a derived time.

29. An encoder for coding an audio signal to obtain an encoded signal, the encoder including:

a predictive coding unit that is configured to code at least part of the audio signal in order to obtain prediction coefficients that represent temporal properties of the at least part of the audio signal;

a transforming unit that is configured to transform the prediction coefficients into a set of times representing the prediction coefficients; and the encoder is configured to include the set of times in the encoded signal, wherein the at least part of an audio signal includes at least a first frame and a second frame, the first frame and the second frame having an overlap including at least one time of each frame, and a given time of the second frame is differentially encoded with respect to a time in the first frame.

* * * * *